US008496062B2

(12) United States Patent
Kajaria et al.

(10) Patent No.: US 8,496,062 B2
(45) Date of Patent: Jul. 30, 2013

(54) GOAT HEAD TYPE INJECTION BLOCK FOR FRACTURING TREES IN OILFIELD APPLICATIONS

(75) Inventors: Saurabh Kajaria, Houston, TX (US); Kendall Keene, Houston, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 350 days.

(21) Appl. No.: 13/006,286

(22) Filed: Jan. 13, 2011

(65) Prior Publication Data

US 2012/0181030 A1 Jul. 19, 2012

(51) Int. Cl.
*E21B 43/26* (2006.01)

(52) U.S. Cl.
USPC ..... 166/308.1; 166/75.15; 166/90.1; 166/177.5

(58) Field of Classification Search
USPC ..... 166/308.1, 90.1, 75.15, 95.1, 177.5
See application file for complete search history.

(56) References Cited

U.S. PATENT DOCUMENTS

| | | | | |
|---|---|---|---|---|
| 1,362,718 | A * | 12/1920 | McNamara | 285/129.2 |
| 1,582,238 | A * | 4/1926 | Arbon | 166/90.1 |
| 3,151,680 | A * | 10/1964 | Parkhurst et al. | 166/89.1 |
| 4,169,504 | A * | 10/1979 | Scott | 166/90.1 |
| 4,290,482 | A * | 9/1981 | Brisco | 166/70 |
| 4,901,563 | A | 2/1990 | Pearson | |
| 5,522,464 | A * | 6/1996 | Piper | 166/77.2 |
| 5,992,544 | A * | 11/1999 | Sprehe | 175/208 |
| 6,457,530 | B1 * | 10/2002 | Lam et al. | 166/368 |
| 6,575,247 | B2 * | 6/2003 | Tolman et al. | 166/305.1 |
| 6,698,915 | B2 | 3/2004 | Dearing et al. | |
| 6,899,172 | B2 * | 5/2005 | McLeod et al. | 166/90.1 |
| 6,964,306 | B2 * | 11/2005 | Bunney | 166/382 |
| 7,213,641 | B2 * | 5/2007 | McGuire et al. | 166/90.1 |
| 7,478,673 | B2 * | 1/2009 | Boyd | 166/90.1 |
| 7,537,052 | B2 * | 5/2009 | Robichaux et al. | 166/193 |
| 7,789,133 | B2 * | 9/2010 | McGuire | 166/90.1 |
| 7,934,546 | B2 * | 5/2011 | McGuire et al. | 166/90.1 |
| 8,100,175 | B2 * | 1/2012 | McGuire et al. | 166/90.1 |
| 8,151,885 | B2 * | 4/2012 | Bull et al. | 166/305.1 |
| 2003/0010498 | A1 * | 1/2003 | Tolman et al. | 166/305.1 |
| 2004/0206507 | A1 * | 10/2004 | Bunney | 166/312 |
| 2004/0251018 | A1 * | 12/2004 | McLeod et al. | 166/75.13 |
| 2012/0181016 | A1 * | 7/2012 | Kajaria et al. | 166/177.5 |
| 2012/0181030 | A1 * | 7/2012 | Kajaria et al. | 166/308.1 |

OTHER PUBLICATIONS

Demong, K. and Keene, K., "Shale Energy: Developing the Horn River", World Oil Online, vol. 231, No. 10, [retrieved from the Internet on Jan. 13, 2011 using <URL: http://www.worldoil.com/SHALE-ENERGY-Developing-the-Horn_River-Independents-and-IOCs-active-in-Horn-River-Basin-october-2010.html>].

* cited by examiner

*Primary Examiner* — Jennifer H Gay
(74) *Attorney, Agent, or Firm* — Locke Lord LLP

(57) ABSTRACT

The disclosure provides a goat head, as a mixing block, for multiple fluids in oilfield applications, the goat head having a reversing directional flow, mixing portion, wear reduction surfaces, and restricted outlet bore. The goat head provides an underneath approach for piping, reducing the overall height, and mixes the fluids dynamically within the goat head from angled flow paths. The goat head then reverses at least a component of the fluid flow direction that enters the wellbore below the goat head and exits the goat head into the well therebelow. The goat head to contains hardened wear surfaces, including surfaces in specific zones, to resist erosion caused by the reversing directional flow. A restricted outlet bore has a cross-sectional area that is less than the sum of cross-sectional areas of the inlets to assist in creating higher velocity and streamlined flow as the fluid exits the goat head.

9 Claims, 8 Drawing Sheets

GOAT HEAD TYPE INJECTION BLOCK FOR FRACTURING TREES IN OILFIELD APPLICATIONS

CROSS REFERENCE TO RELATED APPLICATIONS

The application claims priority to U.S. Non-Provisional application Ser. No. 12/631,834, filed Dec. 6, 2009, which claims the benefit of U.S. Provisional Application No. 61/231,252, filed on Aug. 4, 2009.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates oilfield applications having a pumping system. More particularly, the disclosure relates to oilfield applications having a pumping system that intermixes at least two incoming fluids for fracturing operations.

2. Description of the Related Art

FIG. 1A is an exemplary schematic diagram of a prior art fracturing system for an oilfield fracturing operation. FIG. 1B is an exemplary schematic diagram of a prior art fracturing system, showing fractures in an underlying formation. FIG. 1C is an exemplary schematic diagram of the prior art fracturing system of FIG. 1A detailing a system for one well. The figures will be described in conjunction with each other. Oilfield applications often require pumping fluids into or out of drilled well bores 22 in geological formations 24. For example, hydraulic fracturing (also known as "fracing") is a process that results in the creation of fractures 26 in rocks, the goal of which is to increase the output of a well 12. Hydraulic fracturing enables the production of natural gas and oil from rock formations deep below the earth's surface (generally 5,000-20,000 feet). At such depths, there may not be sufficient porosity and permeability to allow natural gas and oil to flow from the rock into the wellbore 22 at economic rates. The fracture 26 provides a conductive path connecting a larger area of the reservoir to the well, thereby increasing the area from which natural gas and liquids can be recovered from the targeted formation. The hydraulic fracture 26 is formed by pumping a fracturing fluid into the wellbore 22 at a rate sufficient to increase the pressure downhole to a value in excess of the fracture gradient of the formation rock. The fracture fluid can be any number of fluids, ranging from water to gels, foams, nitrogen, carbon dioxide, or air in some cases. The pressure causes the formation to crack, allowing the fracturing fluid to enter and extend the crack further into the formation.

To keep the fractures open after the injection stops, propping agents are introduced into the fracturing fluid and pumped into the fractures to extend the breaks and pack them with proppants, or small spheres generally composed of quartz sand grains, ceramic spheres, or aluminum oxide pellets. The proppant is chosen to be higher in permeability than the surrounding formation, and the propped hydraulic fracture then becomes a high permeability conduit through which the formation fluids can flow to the well.

In general, hydraulic fracturing equipment used in oil and natural gas fields usually includes frac tanks with fracturing fluid coupled through hoses to a slurry blender, one or more high-pressure, high volume fracturing pumps to pump the fracturing fluid to the well, and a monitoring unit. Associated equipment includes fracturing tanks, high-pressure treating iron, a chemical additive unit (used to monitor accurately chemical addition), pipes, and gauges for flow rates, fluid density, and treating pressure. Fracturing equipment operates over a range of pressures and injection rates, and can reach up to 15,000 psi (100 MPa) and 100 barrels per minute (265 L/s). Many frac pumps are typically used at any given time to maintain the very high, required flow rates into the well.

In the exemplary prior art fracturing system 2, fracturing tanks 4A-4F (generally "4") deliver fracturing fluids to the well site and specifically to one or more blenders 8. The tanks 4 each supply the fluids typically through hoses 6A-6F (generally "6") or other conduit to one or more blenders 8. One or more proppant storage units 3 can be fluidicly coupled to the blenders 8 to provide sand or other proppant to the blenders. Other chemicals can be delivered to the blenders for mixing. In most applications, the blenders 8 mix the fracturing fluids and proppant, and delivers the mixed fluid to one or more trucks 5A-5E (generally "5") having high-pressure pumps 9A-9F (generally "9") to provide the fluid through one or more supply lines 10A-10E (generally "10") to a well 12A (generally "12"). The fluid is flushed out of a well using a line 14 that is connected to a dump tank 16. The fracturing operations are completed on the well 12A, and can be moved to other wells 12B and 12C, if desired.

FIG. 2A is an exemplary side view schematic diagram of a prior art goat head. FIG. 2B is an exemplary top view schematic diagram of the prior art goat head of FIG. 2A. FIG. 2C is an exemplary perspective schematic view of an installation of the prior art goat head of FIGS. 2A-2B on a well. The figures will be described in conjunction with each other. A "goat head" 20 is known to be a large block of steel for mixing fluids. The goat head is placed on top of a well 12, resulting in an elevation of about 14-16 feet (5 meters) from the ground. The goat head 20 has a top 21 and a bottom 23 and multiple fluid inlets 28A-28E (generally "28'). Traditionally, the fluid inlets are directed upward toward the top of the goat head, where the supply lines attached to the top inlets resemble "horns" from the top of the "goat head." The inlets 28A-28E allow the fluids to be combined from the multiple supply lines 10A-10E shown in FIG. 1C into a central bore 27 for mixing. The combined flow is directed downward through an outlet 25 into the well 12.

The flow path from the top 21 of the goat head downward into the well 12 is an accepted practice for the industry to reduce pressure losses by reducing the bends and turns of fluid flow. The top-to-bottom flow path also reduces erosion from the sand and other proppants on the goat head bore and other flow surfaces, and increases service life.

One of the significant challenges in fracturing operations is the large number of trucks, pumps, containers, hoses or other conduits, and other equipment for a fracturing system. The system of FIG. 1C is vastly simplified as only showing a few trucks with only one well. In practice, many trucks and pumps are used to provide the cumulative amounts of fluid for the well at a well site which are moved from well to well. The difficulty of working around the wells with the large number of components also causes safety issues.

Recently, efforts in the industry have been directed to more efficiently fracture multiple wells at a given field. The number of assembled equipment components has raised the complexity level of the system and the ability to operate in and around the multiple wells. One of the improvements needed is an improved goat head assembly.

BRIEF SUMMARY OF THE INVENTION

The disclosure provides a goat head, as a mixing block, for multiple fluids in oilfield applications, the goat head having a reversing directional flow, a mixing portion, wear reduction surfaces, and a restricted outlet bore. The goat head provides an underneath approach for piping, reducing the overall height, and mixes the fluids dynamically within the goat head from angled flow paths. The goat head then reverses at least a component of the fluid flow direction that enters the wellbore below the goat head and exits the goat head into the well below the goat head. The goat head contains hardened wear surfaces, including surfaces in specific zones, to resist erosion caused by the reversing directional flow. A restricted outlet bore has a cross-sectional area that is less than the sum of cross-sectional areas of the inlets to assist in creating higher velocity and streamlined flow as the fluid exits the goat head.

The disclosure provides a fracturing system for oilfield applications, comprising: a goat head having a top, bottom, sides, front, and back to form a three-dimensional block, the goat head having a plurality of inlets and at least one outlet, the inlets oriented at an angle between 0 degrees to less than 90 degrees relative to the outlet and at least two of the inlets oriented at a nonparallel angle to each other in a horizontal plane.

The disclosure also provides a method of flowing fracturing fluids through a mixing block, comprising: flowing one or more fluids into at least two inlets of the mixing block at an angle that is between 0 degrees and less than 90 degrees to an outlet of the mixing block; reversing at least a component of a flow direction of the fluids between the inlets and the outlet; and flowing the fluid out through the outlet of the mixing block.

DETAILED DESCRIPTION

Figure 1A:
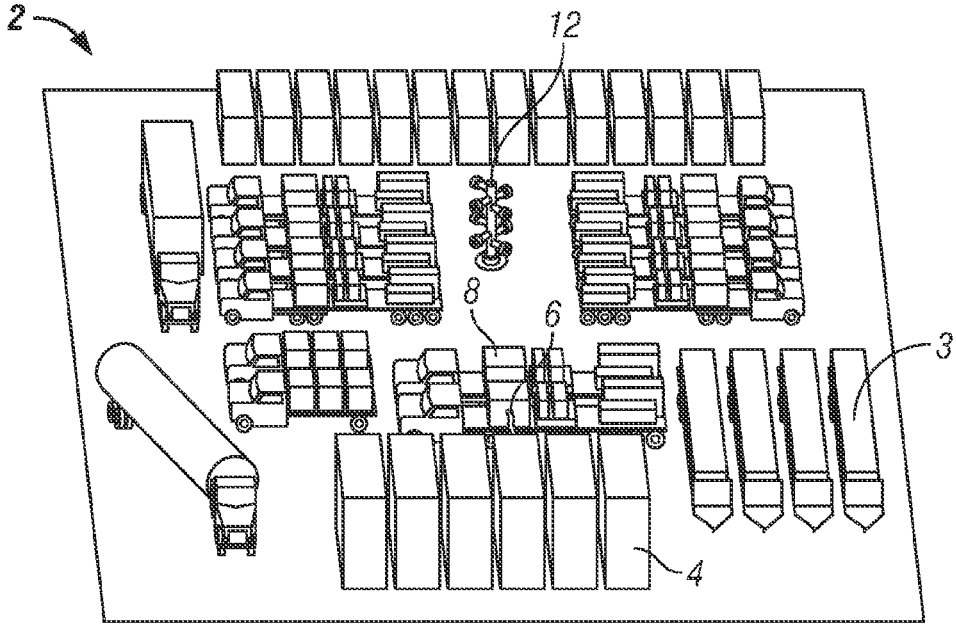
FIG. 1A (Prior Art)
FIG. 1A is an exemplary schematic diagram of a prior art fracturing system for an oilfield fracturing operation.
Figure 1B:
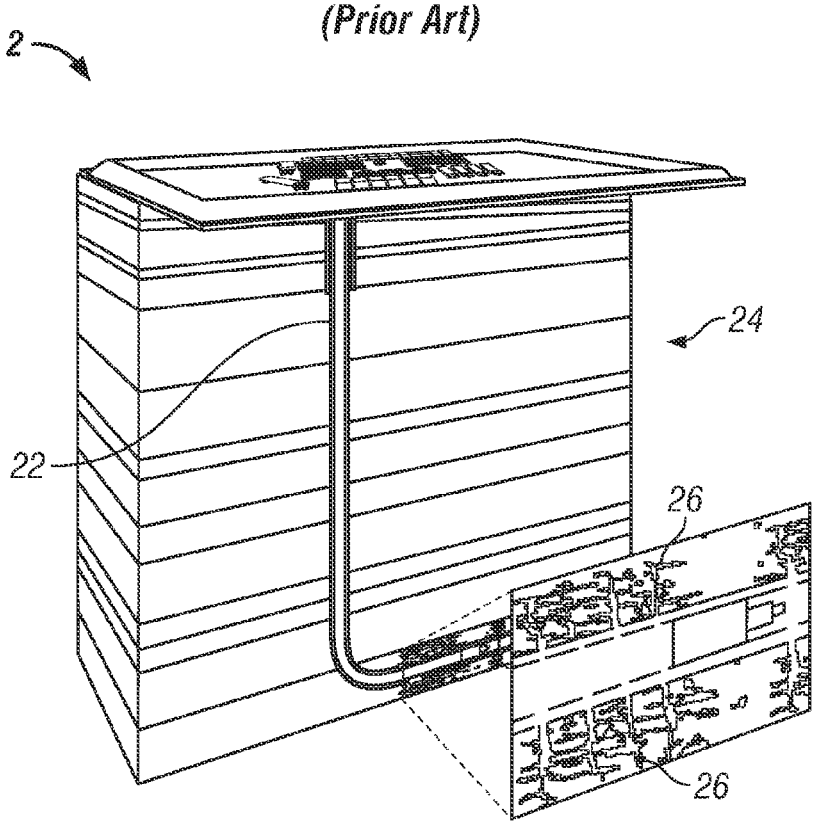
FIG. 1B (Prior Art)
FIG. 1B is an exemplary schematic diagram of a prior art fracturing system, showing fractures in an underlying formation.
Figure 1C:
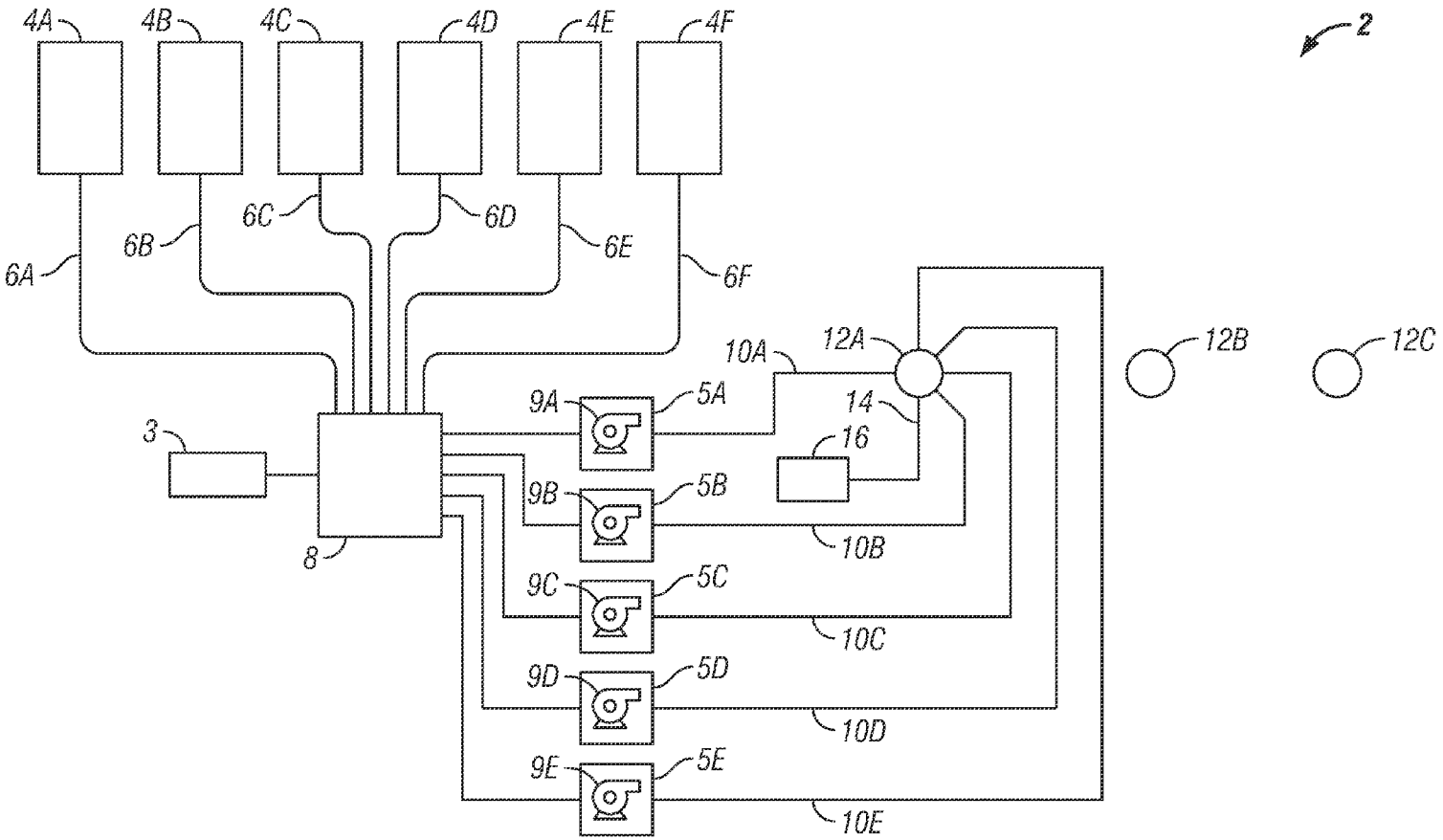
FIG. 1C (Prior Art)
FIG. 1C is an exemplary schematic diagram of the prior art fracturing system of FIG. 1A detailing a system for one well.
Figure 2A:
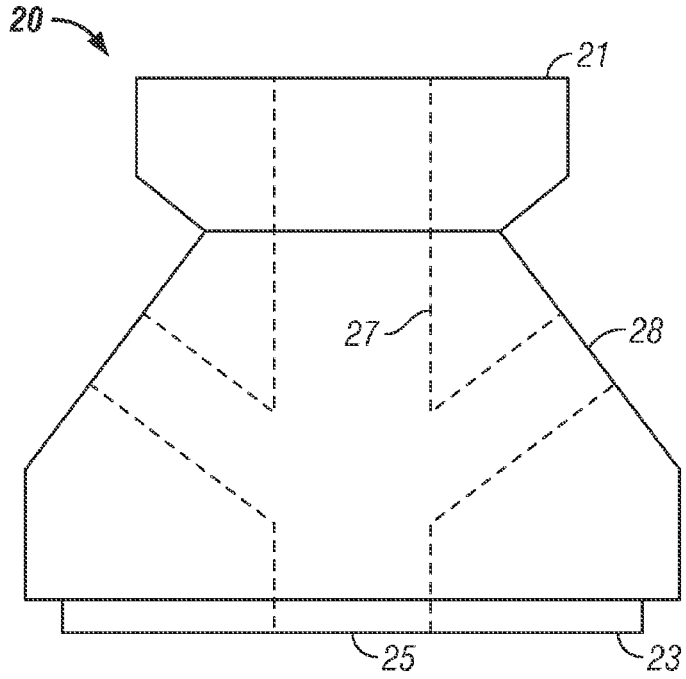
FIG. 2A (Prior Art)
FIG. 2A is an exemplary side view schematic diagram of a prior art goat head.
Figure 2B:
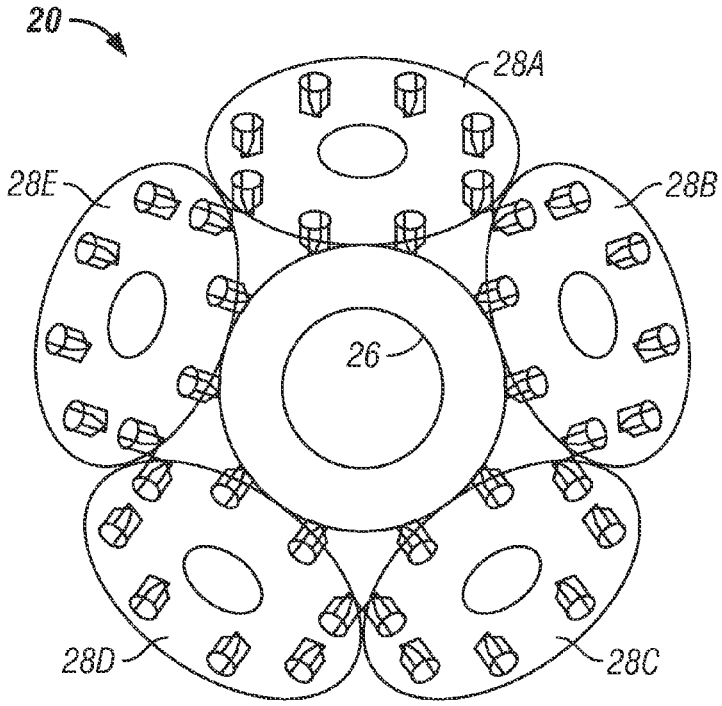
FIG. 2B (Prior Art)
FIG. 2B is an exemplary top view schematic diagram of the prior art goat head of FIG. 2A.
Figure 2C:
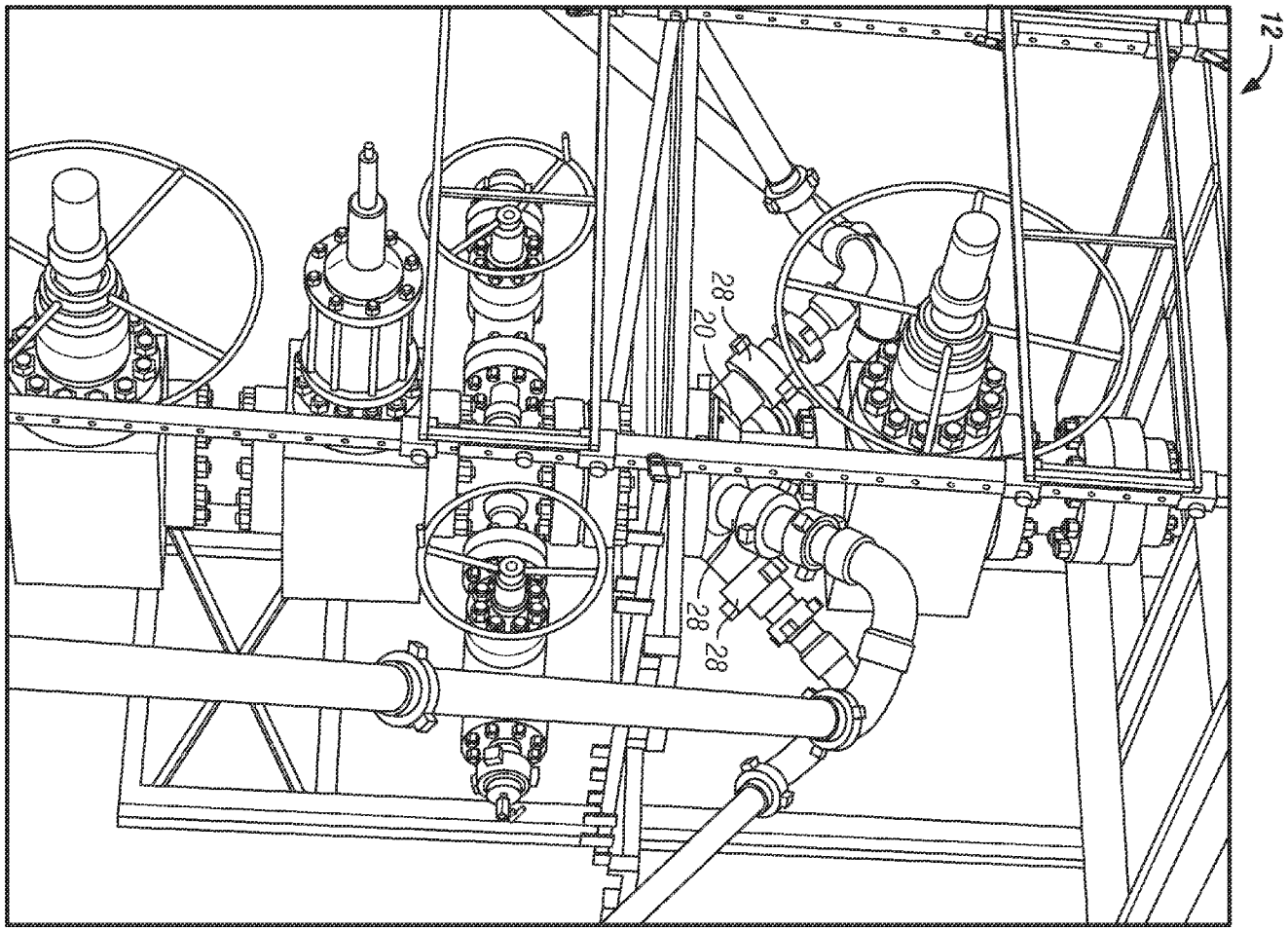
FIG. 2C (Prior Art)
FIG. 2C is an exemplary perspective schematic view of an installation of the prior art goat head of FIGS. 2A-2B on a well.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an "a" or "b" to designate one side of the system or another. When referring generally to such elements, the number without the letter is used. Further, such designations do not limit the number of elements that can be used for that function.

A goat head, as a mixing block, for multiple fluids in oilfield applications, the goat head having a reversing directional flow, mixing portion, wear reduction surfaces, and restricted outlet bore. The goat head provides an underneath approach for piping, reducing the overall height, and mixes the fluids dynamically within the goat head from angled flow paths. The goat head then reverses at least a component of the fluid flow direction that enters the wellbore below the goat head and exits the goat head into the well therebelow. The goat head contains hardened wear surfaces, including surfaces in specific zones, to resist erosion caused by the reversing directional flow. A restricted outlet bore has a cross-sectional area that is less than the sum of cross-sectional areas of the inlets to assist in creating higher velocity and streamlined flow as the fluid exits the goat head.

Figure 3:
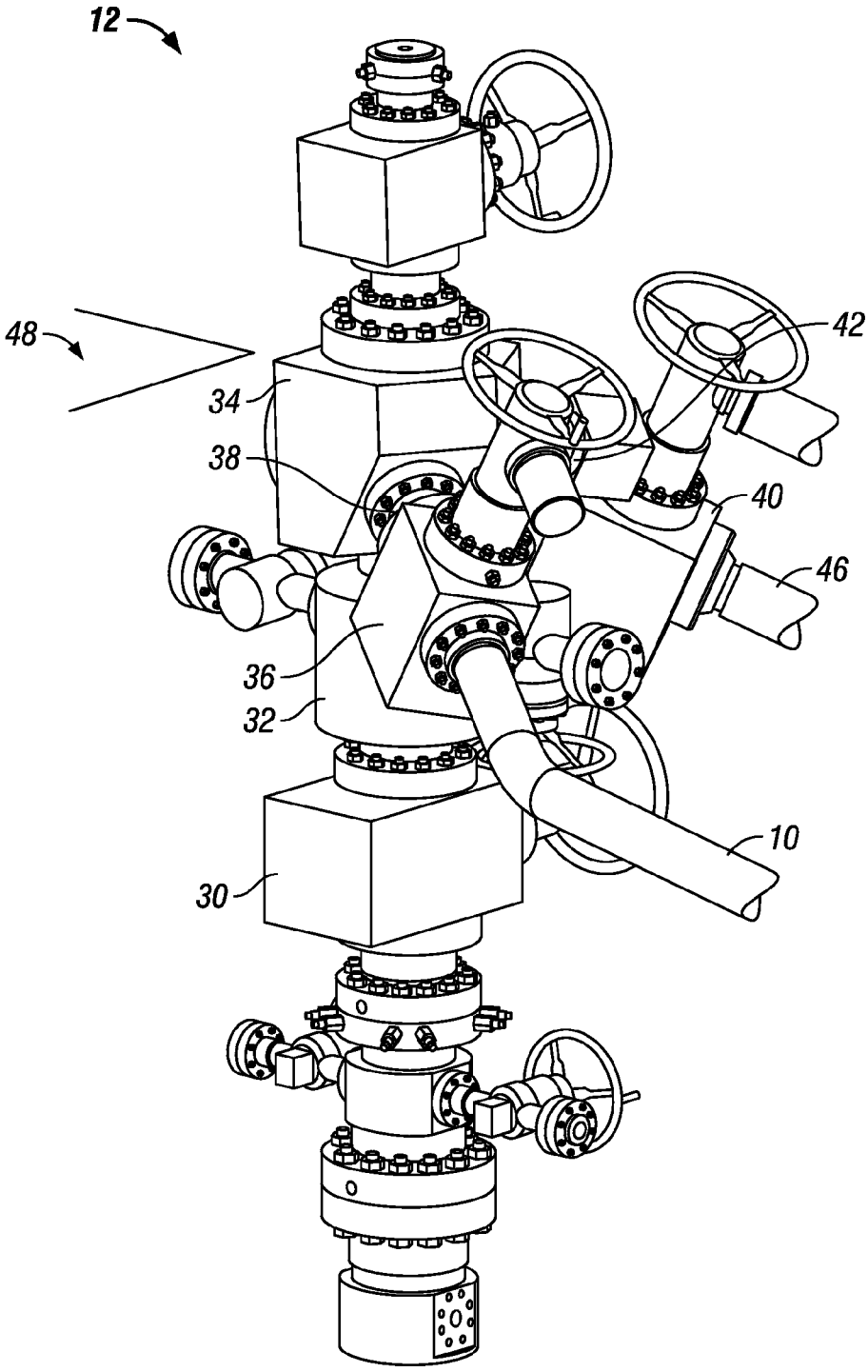
FIG. 3 is an exemplary detail schematic view of a fracturing system with a goat head of the present invention.

FIG. 3 is an exemplary detail schematic view of a fracturing system with a goat head of the present invention. The fracturing system of the present invention can be coupled to the well 12 described above. In general, a goat head 34 acts as a mixing block for fluids entering through the fracturing system and down into the well 12. A valve control 30 is mounted above the well 12 for performing primary well pressure control. A second valve control 32 is mounted above the valve control 30 for performing secondary well pressure control. The goat head 34 can be mounted to the well 12 and one or more of the components disposed below the goat head.

A supply line 10 enters the goat head through a valve block 36 coupled to a spool 38 that is coupled to the goat head 34. A second line 46 enters the goat head through a valve block 40 coupled to a spool 42 that is coupled to the goat head 34. The second line 46 can carry a different fluid from the fluid in line 10. In the exemplary embodiment, the lines 10, 46 and more specifically the spools 38, 42, are coupled to the respective surfaces of the goat head at a nonparallel angle relative to each other, that is, not 0 degrees or 180 degrees, or multiples thereof, when viewed from a top view, as more fully explained regarding FIGS. 4 and 6. The nonparallel angle forms a convergence between the fluids in lines 10, 46 to enhance mixing in the goat head 34. Further, the spools 38, 42 are coupled at an angle to the goat head, when viewed from a side view, that is below a horizontal plane 48 in contrast to traditional orientations, as more fully explained regarding FIGS. 5 and 7. This direction of coupling is counterintuitive, because the fluids must be directed downward into the well 12 and thus traditionally the fluid enters from an angle above the horizontal plane 48. However, in this embodiment, the fluid enters at an angle from below the horizontal elevation of the goat head 34, thus requiring a reversal in flow direction of entering fluid relative to exiting fluid. The goat head 34 of the present invention provides special design features explained below for such an atypical change in flow direction of a fracturing fluid at such pressures and flows.

Figure 4:
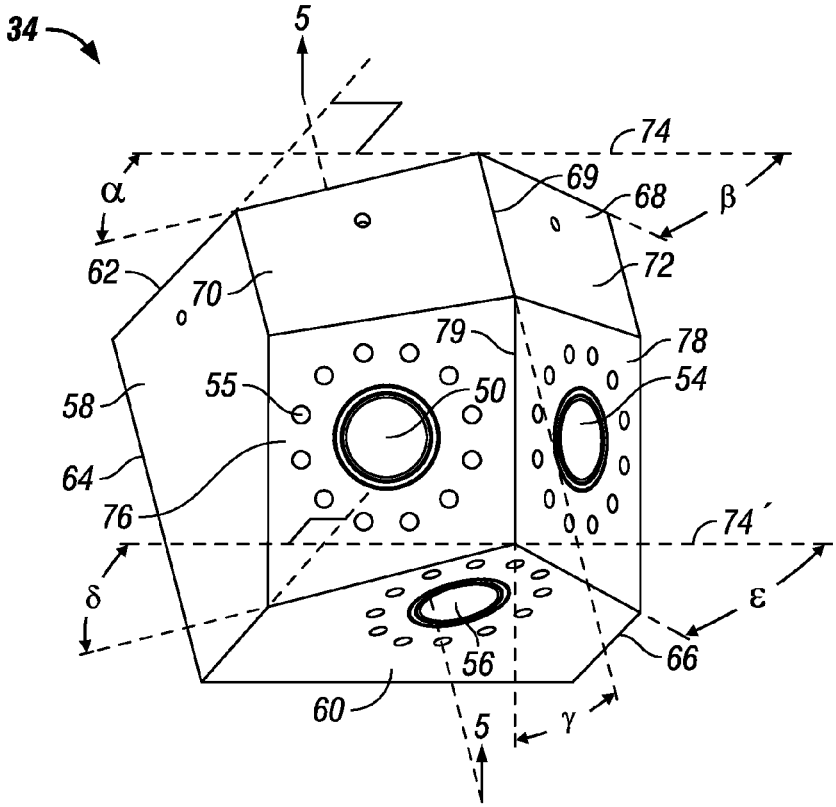
FIG. 4 is a front perspective schematic view of the goat head of FIG. 3.
Figure 5:
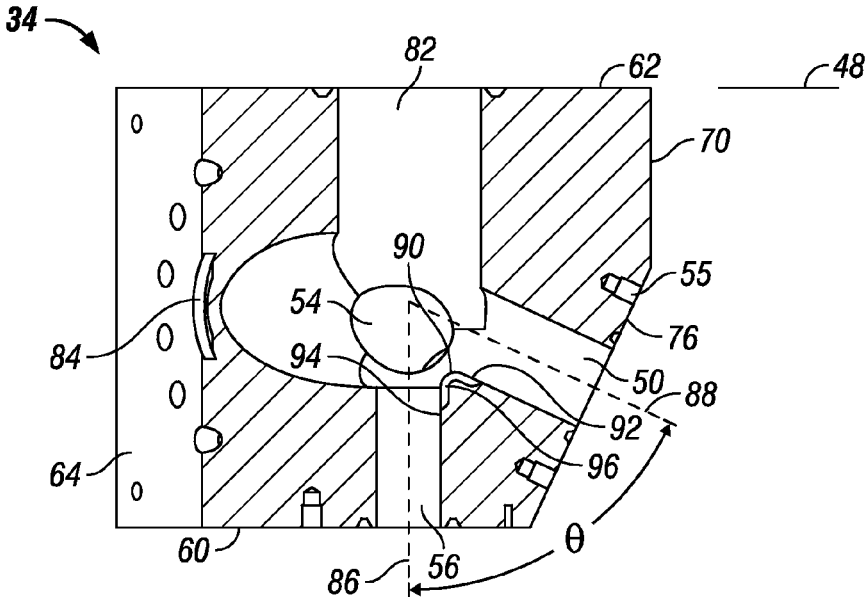
FIG. 5 is a cross-sectional side schematic view of the goat head of FIG. 4.
Figure 6:
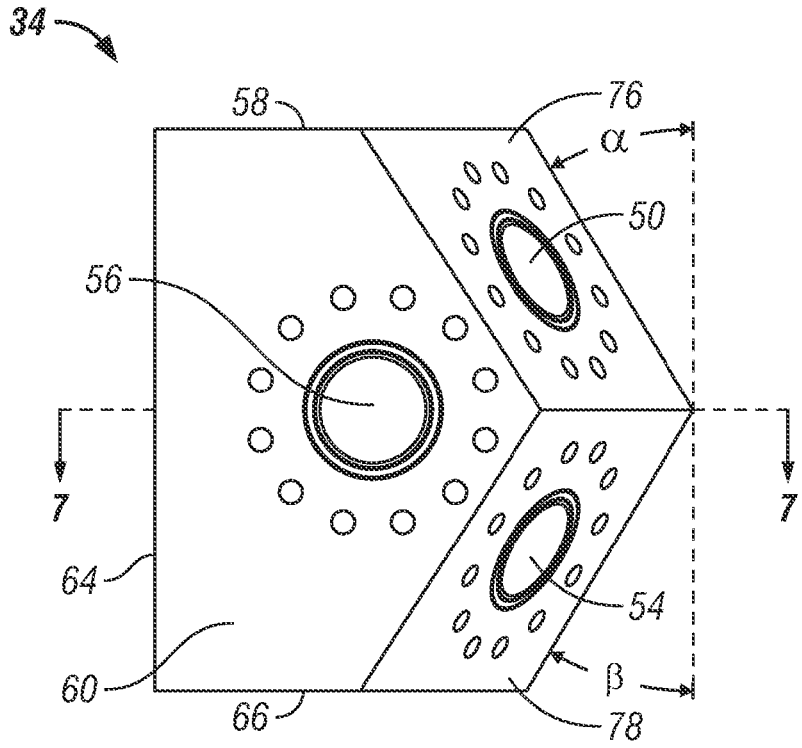
FIG. 6 is a bottom schematic view of the goat head of FIG. 4.
Figure 7:
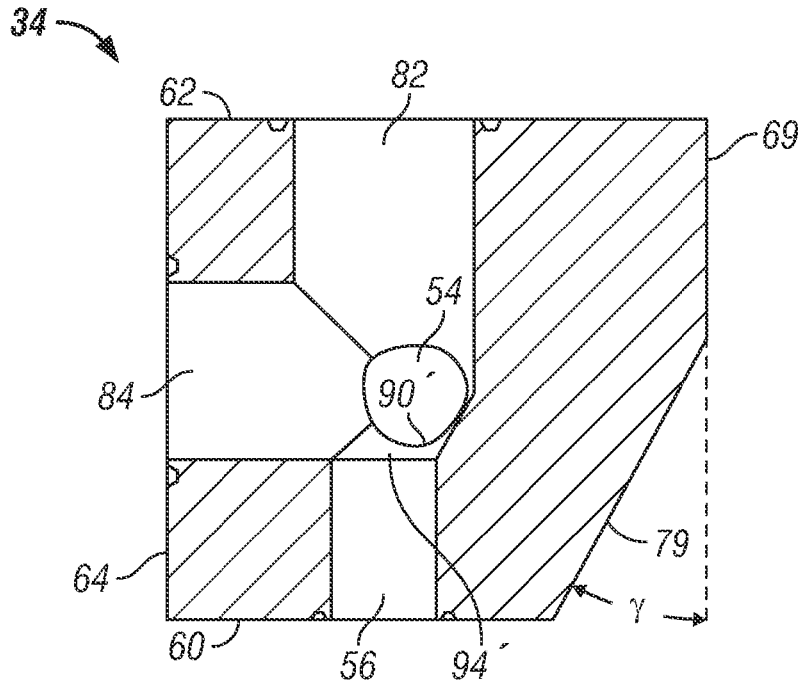
FIG. 7 is a cross-sectional side schematic view of the goat head of FIG. 6.
Figure 8:
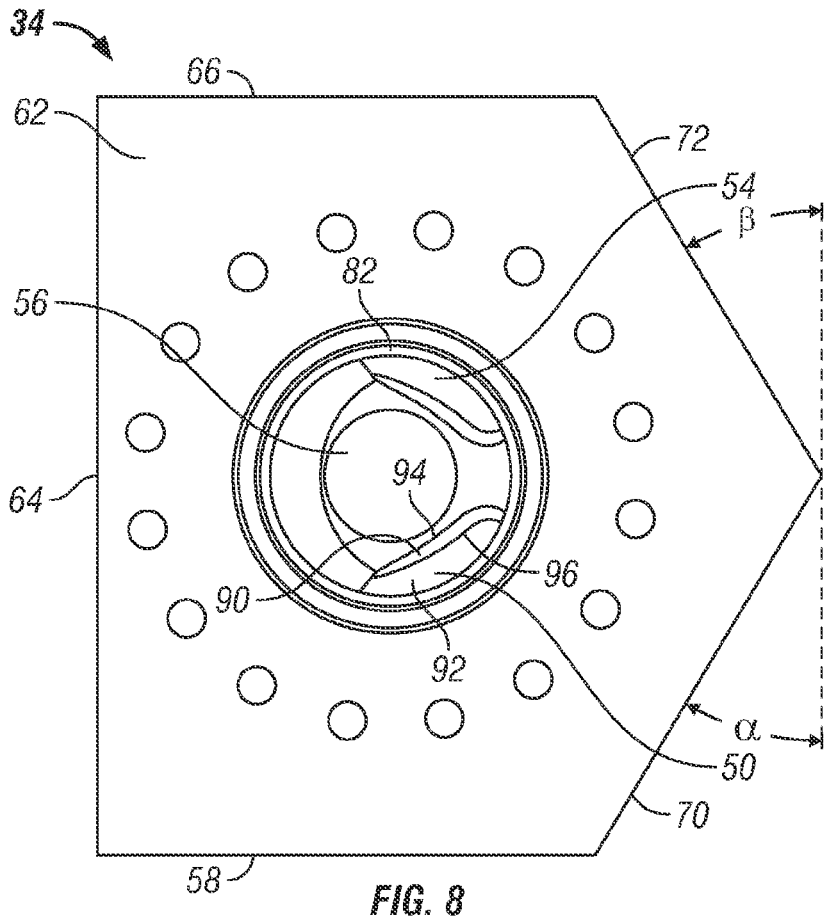
FIG. 8 is a top schematic view of the goat head of FIG. 4.
Figure 9:
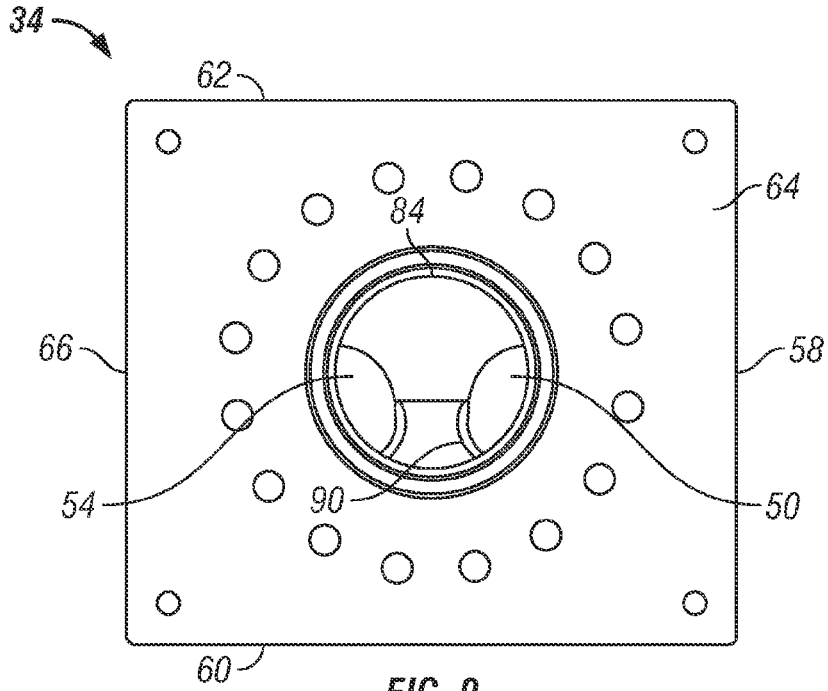
FIG. 9 is a rear schematic view of the goat head of FIG. 4.

FIG. 4 is a front perspective schematic view of the goat head of FIG. 3. FIG. 5 is a cross-sectional side schematic view of the goat head of FIG. 4. FIG. 6 is a top schematic view of the goat head of FIG. 4. FIG. 7 is a cross-sectional side schematic view of the goat head of FIG. 6. FIG. 8 is a bottom schematic view of the goat head of FIG. 4. FIG. 9 is a rear schematic view of the goat head of FIG. 4. The figures will be described in conjunction with each other.

The goat head 34 generally has a front 68, a bottom 60 generally at right angles to the front 68, a side 58 generally at right angles to the front 68 and bottom 60, an opposite side 66 parallel to the side 58, a top 62 at right angles to the side 58 and front 68 and parallel to the bottom 60, and a back 64 parallel to the front 68 and at right angles to the bottom 60 and top 62 and sides 58, 66. The overall shape can be described as "cubicle" or block-shaped although the width, height, and depth dimensions can vary from being equal. The front 68 can include two surfaces that are angled away from a longitudinal ridge 69 along a vertical middle of the front face 68. A first front upper face 70 can be angled backward from the ridge 69 in the direction of the back 64 at a lateral angle "α" measured from a line 74 that is perpendicular to the side 58 and tangent to the ridge 69. A second upper front face 72 can be angled backwards from the ridge 69 toward the back 64 at a lateral angle "β" from the line 74, which may be equal to the angle "α". The front faces 70, 72 are thus angled at a nonparallel angle relative to each other, that is, not 0 degrees or 180 degrees.

Further, the front 68 can include faces that are formed at both a lateral angle and at a longitudinal angle to the front ridge 69. Specifically, an angled longitudinal ridge 79 is formed at a longitudinal angle "γ" relative to the longitudinal ridge 69 of the upper front faces, so that the angled longitudinal ridge 79 is directed away from the front 68 and toward the back 64. A first inlet face 76 can be angled backward from the ridge 79 in the direction of the back 64 at a lateral angle "δ" measured from a line 74' that is perpendicular to the side 58 and tangent to the ridge 79. A second inlet face 78 can be angled backward from the ridge 79 in the direction of the back 64 at a lateral angle "ϵ" measured from the line 74'. In at least one embodiment, the lateral angles "α" and "δ" can be the same or similar, and the lateral angles "β" and "ϵ" can be the same or similar. Thus, a perpendicular line from the inlet faces 76, 78 points downward at an angle that is below the horizontal plane 48 when the goat head 34 is mounted vertically above the typical well 12, described above.

The goat head 34 further includes various ports for allowing entry and exit of the fracturing fluids. For example, a first inlet 50 having a centerline 88 can be formed in the first inlet face 76. Various attachment means 55, such as bolt holes, threads, quick disconnects, and other fastening mechanisms can be provided for attaching piping, tubing, hoses, or other conduit to the inlet face. Similarly, a second inlet 54 having a similar centerline can be disposed on the second inlet face 78 with various attachment means suitable for the application. An outlet 56 having a centerline 86 is generally disposed on the bottom 60 and generally aligned vertically with the bore of the well 12 when mounted thereon for flowing fluids into the well. A top port 82, shown in FIG. 5, can be provided for access to internal structures in manufacturing and for flowing one or more fluids in or out of the goat head 34.

Due to the angles of the inlet faces 76, 78 described above, the inlets 50, 54 are directed downward at an angle that is below the horizontal plane 48 when the outlet 56 is aligned vertically with the well 12, described above. Thus, as shown in FIG. 5, an angle "θ" between a centerline 88 of the inlet 50 (and corresponding centerline of the inlet 54) to a centerline 86 of the outlet 56 can be from 0 degrees (for a full reversal of flow direction) to less than 90 degrees (for a partial reversal of flow direction) and any angle therebetween, including 45 to 75 degrees. In a geometrical coordinate system, a least a component of the angle of flow between the inlets and the outlets would be reversed.

One of the challenges of such a goat head is the erosion caused by such high flow and high-pressure abrasive fluids changing radical flow directions as described herein. The fracturing fluid must flow into the goat head 34 at the angle "θ" and then change directions into a downward direction into the well 12, described above. The change in direction involves in a change in potential energy of the fluid in addition to its kinetic energy while flowing. The energy of the fluid and its change between the inlets 50, 54 and the outlet 56 can cause severe erosion along the flowing surfaces. The present goat head provides several design features for allowing the change in flow direction to occur to accomplish its other purposes and still suitably function a sufficient time during the fracturing operations without eroding away significant flow surfaces. Specifically, erosion can occur along an inside inlet surface 92, across a bend 90 as the flow changes direction, and then along an inside outlet surface 94. Along those surfaces, a hard surfacing alloy 96 can be deposited to increase erosion resistance. Various hard surfacing alloys include Inconel®, tungsten carbide, and others known to those in the art. While other hard surfacing areas can be formed in the flow passages, experimental results have shown that the areas around the bend 90 and adjacent surfaces are particularly prone to erosion and thus benefit from hard surfacing.

Further, a back port 84 can also be provided in the goat head 34. The back port 84 can be coupled and can be used for access to internal structures in manufacturing. The back port can also provide surface to mount a sacrificial flange or plate for fluids entering through the inlets 50, 54 to impact and dissipate their kinetic energy while the fluids are mixed in the goat head.

In at least one embodiment, the inlets 50, 54 are larger in diameter and cross-sectional flow area than the outlet 56. The difference in size assists in controlling flow through the goat head and creating a more laminar flow exiting the goat head.

Thus, the cross-sectional square area of the outlet 56 is generally less than the combined cross-sectional area of the inlets 50, 54. In at least one embodiment, the outlet cross-sectional flow area can be equal to one of the inlets 50, 54.

Other and further embodiments utilizing one or more aspects of the invention described above can be devised without departing from the spirit of the invention. For example, the number of outlets or inlets can vary, the shape of the goat head can vary, and the number of faces on the goat head can vary. Other variations in the system are possible.

Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A fracturing system for oilfield applications, comprising:

a goat head having a top, bottom, sides, front, and back to form a three-dimensional block, the goat head having a plurality of inlets and at least one outlet, the inlets oriented at an angle between 0 degrees to less than 90 degrees relative to the outlet and at least two of the inlets oriented at a nonparallel angle to each other in a horizontal plane, wherein the goat head comprises an opening positioned to receive a flow impact of at least one of the inlets and further comprising a removable cover coupled to the opening to deflect the flow impact.

2. The system of claim 1, wherein the opening is formed on the back of the goat head and the inlets are formed on the front of the goat head.

3. A fracturing system for oilfield applications, comprising:

a goat head having a top, bottom, sides, front, and back to form a three-dimensional block, the goat head having a plurality of inlets and at least one outlet, the inlets oriented at an angle between 0 degrees to less than 90 degrees relative to the outlet and at least two of the inlets oriented at a nonparallel angle to each other in a horizontal plane, further comprising a bend formed over a flow surface that changes an angle of fluid flow from the inlets into the outlet.

4. The system of claim 3, wherein at least a portion of the bend comprises a hardened wear surface.

5. The system of claim 3, wherein the outlet comprises a cross-sectional area that is less than a sum of cross-sectional areas of the inlets.

6. The system of claim 3, wherein the outlet comprises a cross-sectional area that is equal to a cross-sectional area of one of the inlets.

7. The system of claim 3, further comprising two or more conduits coupled to the inlets of the goat head and one or more pumps coupled to one or more of the conduits.

8. A method of flowing fracturing fluids through a mixing block, comprising:

flowing one or more fluids into at least two inlets of the mixing block at an angle that is between 0 degrees and less than 90 degrees to an outlet of the mixing block;

at least partially reversing a flow direction of the fluids between the inlets and the outlet; and flowing the fluid out through the outlet of the mixing block, wherein reversing the flow direction comprises flowing the fluids over a bend formed over a flow surface that changes an angle of fluid flow from the inlets into the outlet.

9. The system of claim 8, further comprising flowing the fluid at the bend over a hardened wear surface.

* * * * *